US006150575A

United States Patent [19]

Angevine et al.

[11] Patent Number: 6,150,575

[45] Date of Patent: Nov. 21, 2000

[54] DIESEL FUEL

[75] Inventors: Philip J. Angevine, Woodbury, N.J.; Joan C. Axelrod, Media, Pa.; Alan M. Horowitz, Moorestown; Dennis H. Hoskin, Westampton, both of N.J.

[73] Assignee: Mobil Oil Corporation, Fairfax, Va.

[21] Appl. No.: 09/411,685

[22] Filed: Oct. 4, 1999

Related U.S. Application Data

[60] Provisional application No. 60/108,047, Nov. 12, 1998.

[51] Int. Cl.[7] ..... C10L 1/08

[52] U.S. Cl. ..... 585/14; 44/300

[58] Field of Search ..... 585/14; 44/300

[56] References Cited

U.S. PATENT DOCUMENTS

| | | | |
|---|---|---|---|
| 4,419,220 | 12/1983 | LaPierre et al. | 208/111 |
| 4,435,275 | 3/1984 | Derr et al. | 208/89 |
| 4,494,961 | 1/1985 | Venkat et al. | 44/300 |
| 4,710,485 | 12/1987 | Miller | 502/213 |
| 5,128,024 | 7/1992 | LaPierre et al. | 208/89 |
| 5,282,958 | 2/1994 | Santilli et al. | 208/111 |
| 5,389,111 | 2/1995 | Nikanjam et al. | 44/300 |
| 5,389,112 | 2/1995 | Nikanjam et al. | 44/300 |
| 5,405,417 | 4/1995 | Cunningham | 44/322 |
| 5,583,276 | 12/1996 | Hellrin et al. | 585/22 |
| 5,611,912 | 3/1997 | Han et al. | 208/58 |
| 5,639,931 | 6/1997 | Hellrin et al. | 585/722 |
| 5,792,339 | 8/1998 | Russell | 208/15 |
| 5,814,109 | 9/1998 | Cook et al. | 44/300 |
| 5,865,985 | 2/1999 | Desai et al. | 585/269 |
| 5,976,201 | 11/1999 | Barry et al. | 44/413 |
| 6,004,361 | 12/1999 | Barry et al. | 44/413 |

FOREIGN PATENT DOCUMENTS

| | | |
|---|---|---|
| 687 289 | 2/1994 | European Pat. Off. . |

*Primary Examiner*—Jacqueline V. Howard
*Attorney, Agent, or Firm*—Malcolm D. Keen

[57] ABSTRACT

Diesel fuels which have good ignition qualities, good combustion emission performance and good low temperature characteristics are characterized by a cetane number of at least 45, a total aromatics content of 10 to 15 wt. pct., a polynuclear aromatics content of less than 11 wt. pct., a sulfur content of not more than 50 ppmw, a total nitrogen content (from all sources) of not more than 100 ppmw, and excellent low temperature flow properties as manifested by a pour point not higher than −12° C. and a cloud point not higher than −10° C.

10 Claims, No Drawings

DIESEL FUEL

This application claims the benefit of U.S. Provisional No. 60/108,047 filed Nov. 12, 1998.

FIELD OF THE INVENTION

This invention relates to diesel fuel compositions and more particularly to diesel fuel compositions with good ignition characteristics, good combustion emissions performance and good low temperature flow properties. These fuels are well adapted to use in forthcoming generations of diesel engines.

BACKGROUND OF THE INVENTION

Diesel engines are widely used in a number of applications including road vehicles and off the road vehicles and are notable for their durability and efficiency. Environmental concerns have, however, led to regulation by various government agencies. For example, the United States Environmental Protection Administration (EPA) has established a minimum cetane number requirement of 40 and a maximum sulfur content of 500 ppmw for road diesel fuels and the California Air Resources Board (CARB) has set a maximum aromatics content for commercial road diesel fuels of 10 vol. % (9.5 wt. %). As an alternative to meeting the 10% aromatic specification, CARB permits some diesel fuels with aromatics content above 10 vol. % to be produced and sold in California if it can be established that the higher aromatic diesel fuels have combustion emissions which are no worse than those of a reference fuel containing 10 vol. % maximum aromatics. Subsection g of Section 2282, Title 13, California Code of Regulations, describes the procedure for certifying diesel fuels of equivalent emissions reductions. The emissions performance of a ASTM D975 No. 2-D low sulfur diesel fuel is subjected to comparative emissions testing by the procedure set out in the regulations in a diesel engine such as a Detroit Diesel Corporation Series-60 engine (or other specific engine designated by CARB) against a low aromatics (10 vol. % max.) diesel fuel which conforms to the following product specification:

TABLE 1

| CARB 10% Aromatics Reference Fuel Specifications | | |
|---|---|---|
| Aromatics | ASTM D 1319 | 10 vol % Max |
| | ASTM D 5186 | 95 wt % max |
| Flash | ASTM D 93 | 54° C. Min. |
| Gravity | ASTM D 287 | 33–39 API |
| Natural Cetane Number | ASTM D 613 | 48 Min. |
| Nitrogen | ASTM D 4629 | 10 ppmw Max. |
| Polycyclic Aromatics | ASTM D 2425 | 1.4% wt. % Max. |
| Sulfur | ASTM D 2622 | 500 ppmw Max. |
| Distillation C., ASTM D 86 | | |
| Initial Boiling Point | 171–216 | (340–420° F.) |
| 10% Recovered | 204–254 | (400–490° F.) |
| 50% Recovered | 243–293 | (470–560° F.) |
| 90% Recovered | 288–321 | (550–610° F.) |
| End Point | 304–349 | (580–660° F.) |

If the fuel provides equivalent emission benefits to the reference fuel, i.e. is at least as good as the reference fuel in emissions performance, it can be certified by CARB for sale in California: fuels equivalent to the certified fuel, i.e., diesel fuels having at least the cetane number of the certified candidate fuel, with a sulfur content, aromatic content, polycyclic aromatic hydrocarbon content, and nitrogen content no greater than the "certified" candidate fuel, can be legally sold. Because both EPA and CARB regulations limit sulfur content the sulfur content of the fuel has to be greater than 500 ppmw, limiting it to the low sulfur 2-D diesel fuel specification.

Diesel fuels which are stated to be in compliance with the CARB regulations are described in U.S. Pat. Nos. 5,389,111 (Nikanjan/Chevron), 5,389,112 (Nikanjan/Chevron) and 5,792,339 (Russell/Tosco).

Diesel fuels with good performance properties, especially of particulate emissions, and which are suitable for underground mining operations are described in EP 687 289.

While the diesel fuels described in the patents identified above represent approaches to the problem of providing diesel fuels for road and mining vehicles with improved emission characteristics, other problems remain. Cetane number is a generally accepted indicator of diesel fuel ignition quality, with higher cetane numbers representing improved ignition quality. Cetane number improvement can generally be achieved in one of two ways. Cetane number improving additives are known which can be added to various basestocks to improve the ignition quality. These additives in general, however, are nitrates, for example, octyl (normally 2-ethylhexyl) nitrate which increase the nitrogen content of the fuel and lead to increased emissions of nitrogen oxide (NOx). The alternative to using cetane number improvers is to use a fuel stock of higher intrinsic cetane number and stocks of this kind can generally be characterized as paraffinic stocks, with the straight-chain paraffins having the highest cetane numbers. See Kirk Othmer, *Encyclopedia of Chemical Technology,* 4th Ed. page 290, also *Modern Petroleum Technology,* 4th Edition, G. D. Hobson (Ed), Applied Science Publishers Limited, Barking U.K., ISBN 0853344876 (page 618). The highest cetane numbers in diesel fuel stocks are therefore obtained with blends which have a high content of normal paraffins but the problem with these stocks is that they will have poor low temperature flow properties. For example, the pour point and cloud point of these products will be relatively high as a result of the presence of the straight-chain paraffins. High cetane diesel fuels are therefore unlikely to be useful in cold climates as long as they contain high levels of the waxy straight-chain paraffins.

SUMMARY OF THE INVENTION

We have now developed diesel fuels suitable for use in automotive diesel engines. These fuels are useful in road vehicles and off the road vehicles and have good ignition qualities, good combustion emission performance and good low temperature characteristics. According to the present invention, the present fuels are characterized by a combination of properties set out in Table 1 below.

TABLE 2

| Property | Test | Value |
|---|---|---|
| Cetane number | ASTM D613 | 45+ |
| Aromatics, total, wt. % | ASTM D5186 | 10–15 |
| Polynuclear[2] aromatics, wt. %, | ASTM D2425 | <11 |
| Sulfur, ppmw, | ASTM D2622-1 | <50 |
| Nitrogen, ppmw | ASTM D4629 | <100[1] |
| Pour Point, ° C. | ASTM D97 | <−12 |
| Cloud Point, ° C. | ASTM D2500 | <−10° C. |
| Viscosity, 40° C. | ASTM D445-3 | >2 |
| Viscosity, 100° C. | ASTM D445-3 | >1 |

Notes:
1. Total nitrogen, including contribution from additives
2. Two rings and higher The compositional and performance parameters of fuels identified above are determined by the test procedures indicated.

DETAILED DESCRIPTION

As noted above, the present fuels are characterized by a favorable combination of performance properties including good ignition quality as measured by cetane number and by satisfactorily low combustion emissions performance. Fuels in accordance with the parameters set out above would be satisfactory for sale in California under one of the certifications issued by CARB as providing emission benefits at least equivalent to the emission benefit from the 10 vol. % standard reference diesel fuel.

The paraffinic diesel fuels of this invention may be produced by blending suitable diesel stocks in order to achieve the desired composition. Since the characteristic high cetane value with good low temperature performance can be obtained by the use of fuel stocks which contain a relatively high content of iso-paraffins of relatively good cetane number and excellent low temperature viscometrics, the present stocks will normally include or be composed of a blend component which is produced by the isomerization of a paraffinic feed. Paraffinic gas oils can be effectively treated in this way to produce the present diesel fuels as may other paraffinic stocks such as hydrocracked oils, including hydrocracker bottoms. A highly suitable hydrocracking process for producing a low sulfur fuel oil stock which can be hydroisomerized to produce a high quality, low pour point diesel fuel according to the present invention is described in U.S. Pat. No. 4,435,275 (Derr).

Effective processes for the isomerization of mixed paraffinic/aromatic feeds are known. One such process is described in U.S. Pat. No. 4,419,220 (LaPierre), using a catalyst based on zeolite beta in combination with a noble metal as a hydrogenation/dehydrogenation component to mediate the necessary reactions for the isomerization process to proceed. Zeolite beta is highly useful for the isomerization of mixed paraffin/aromatic feeds such as gas oils either alone or in combination with other feed components described below since it is capable of catalyzing the desired paraffin isomerization reactions in the presence of aromatics. Feeds such as atmospheric gas oils, vacuum gas oils, as well as middle distillate feeds such as kerosene may be processed in this way. Reference is made to U.S. Pat. No. 4,419,220 for a description of this process.

An alternative method for the production of fuel streams containing isoparaffins would be the combined hydrocracking/paraffin isomerization process using a zeolite beta catalyst as described in U.S. Pat. No. 5,128,024 (LaPierre), to which reference is made for a description of the process. The zeolite beta component of the catalyst is able to effect conversion of paraffins in the presence of aromatics to produce more highly branched isoparaffins which, although of lower cetane number than straight-chain paraffins, possess a relatively good cetane number in combination with improved low temperature viscometrics, which is characteristic of the present diesel fuels. The process is capable of producing hydrocracked low pour point products which possess characteristically high levels of isoparaffins produced by ring opening of aromatic components of the feed as well as by isomerization of paraffins in the feed and produced by hydrocracking reactions.

Other catalysts besides zeolite beta are also known to be effective for the isomerization of long chain ($C_7$+) paraffins in various feedstocks, for example, the large pore, highly siliceous zeolite catalyst such as zeolite Y or ZSM-20 having a structural silica:alumina ratio of at least 10:1, as described in U.S. Pat. Nos. 4,855,530 and 5,128,024. The use of the highly siliceous zeolite inhibits the degrees of cracking and also permits weaker hydrogenation components such as palladium to be used in the catalyst. See also EP 94826 for a description of such catalysts and processes.

Paraffin isomerization catalysts and processes which can be used with gas oil feeds for producing low pour point diesel fuel blendstocks are also found in U.S. Pat. Nos. 4,710,485 (Miller); 4,689,138 (Miller); 4,859,312 (Miller—combined hydrocracking/isomerization); and 5,149,421 (Miller). U.S. Pat. No. 5,282,958 (Santilli) describes a process for dewaxing various feeds such as kerosene and jet fuel, gas oils and vacuum gas oils by an isomerization type process. The catalysts which may be used in the process include 10 and 12 member ring molecular sieves such as the zeolites ZSM-12, ZSM-21, ZSM-22, ZSM-23, ZSM-35, ZSM-38, ZSM-48, ZSM-57, SSZ-32, ferrierite and zeolite L as well as other molecular sieve materials based upon aluminum phosphates such as SAPO-11, SAPO-31, SAPO-41, MAPO-11 and MAPO-31. Reference is made to U.S. Pat. No. 5,282,958 for a description of such isomerization processes using molecular sieves for the isomerization of paraffinic components of suitable feedstocks such as gas oils and other distillates. Processes of this type using the zeolites such as ZSM-12, ZSM-21, ZSM-22, ZSM-23, ZSM-35, ZSM-38, ZSM-48, ZSM-57 and other molecular sieve materials as described there may be used to make the isoparaffinic components of the present diesel fuels.

Isomerization type processes are also described in the paper *Selective hydroisomerization of long chain normal paraffins*, Taylor et al, Applied Catalysis A: General 119 (1194), 121–138.

Isomerized paraffin blend stocks produced by these or other paraffin isomerization processes can be blended with other various stocks such as low sulfur virgin kerosenes, low sulfur atmospheric gas oils, coker gas oils, visbreaker gas oils and FCC light cycle oils (LCO) as well as hydrocracked stocks such as hydrocracker bottoms. These blend stocks may also be passed through the isomerization process in combination with the paraffinic feed in order to achieve the final combination of good quality with good low temperature viscometrics. If it is necessary to bring the paraffinic stock either by itself or in combination with another stock to a specific pour point or to achieve other low temperature flow properties, catalytic dewaxing processes may be used such as the well known MDDW process using a ZSM-5 catalyst, as described in *Shape Selective Catalysis in Industrial Applications*, Chen et al, ISBN 0 8247 7856 1, or processes based on other catalytic materials such as the other medium pore size zeolites including ZSM-11, ZSM-22, ZSM-23, ZSM-35 and other zeolites as noted, for example, in U.S. Pat. No. 5,282,958 (Santilli).

The compositional parameters set out above should be followed in order to obtain the desired combination of properties in the diesel fuel. The observance of certain narrower ranges within the ranges above may however lead to an enhancement of overall performance, an improvement in product economics or both. Suitable preferred ranges are set out below in Table 3, using the same tests as listed in Table 2 above.

TABLE 3

| Property | Board Value | Preferred Value | Optimum Value |
|---|---|---|---|
| Cetane number | 45+ | 50+ | 55–68 |
| Aromatics, total, wt. % | <15 | 10–15 | |
| Polynuclear[2] aromatics, wt. %, | <11 | 0.2–10 | 0.5–5.0 |
| Sulfur, ppmw | <50 | <30 | <10 |

TABLE 3-continued

| Property | Board Value | Preferred Value | Optimum Value |
|---|---|---|---|
| Nitrogen, ppmw | <100[1] | <50 | <20 |
| Pour Point, ° C. | <−12 | <−20 | <−30 |
| Cloud Point, ° C. | <−10 | <−20 | <−30 |
| Viscosity, 40° C., cSt | 1.9–4.1 | | |
| Viscosity, 100° C. | — | >1 | |

Notes:
1. Total nitrogen, including contribution from additives
2. Two rings and higher Within these ranges, particular values of note can be achieved. For example, although Cloud Point is according to ASTM D975, to be determined by agreement between the seller and purchaser, it is recommended that it should be 6° C. above the 10th percentile charts in Appendix X4 of the standard, making the lowest suggested cloud point for the 48 contiguous states −28° C. for Minnesota in January. The present fuels can however be produced with markedly lower cloud points, for example, −33° C. and −43° C. Similarly, Pour Points below the indicated values are eminently achievable, for example, −27°, 39°, 48° and −57° C.

These diesel fuels will normally conform to the 2-D diesel fuel specification (ASTM D 975). Consistent with their character as low sulfur D2 diesel fuels, the present fuels will usually have a flash point (ASTM D93) of 52° C. minimum, and a $T_{90}$ of 282°–338° C. with other product specifications also in accordance with ASTM D 975 for low sulfur 2-D diesel fuels. It has been noted, however, that the excellent low temperature properties of the present diesel fuels coupled with their good ignition qualities renders them suitable for use in road and off the road vehicle high speed diesel engines even in cases when they do not conform to the 2-D specifications. For example, improved lubricity characteristics are obtained with fuels of relatively higher end point above the 338° C. permitted by the 2-D specification and for this reason, the $T_{90}$ value may be above 338° C., for example, up to 400° C. although at higher end points (and correspondingly higher values of $T_{90}$), the viscosities at 40° and 100° C. may be too high to meet conventional viscosity requirements for use in normal injection systems. Lubricity as shown by wear scar values of no more than 460 μm in the HFRR test are readily attainable as shown below even with low viscosity fuels conforming to the 2-D specification.

The present diesel fuels may contain conventional diesel fuel additives in appropriate proportions, including lubricity improvers, detergents and friction reducers. Additives of this kind and the amounts in which they may be used are described in EP 687 289. Cetane number improvers such as octyl nitrate may be added but the overall limitation on nitrogen content including the contribution from the additives makes the extended use of these additives unattractive for any but minor adjustments to cetane number.

EXAMPLES 1 AND 2

Two examples of low sulfur diesel fuels produced by the hydroisomerization of a hydrotreated Arab Light Atmospheric Gas Oil (ALGO) are set out below in Table 4.

TABLE 4

| Property | Example 1 | Example 2 |
|---|---|---|
| Cetane number | 56 | 55.3 |
| Aromatics, total, wt. % | 14.0 | 13.6 |
| Aromatics, mononuclear, wt. % | 13.4 | 10.3 |
| Polynuclear[2] aromatics, wt. %, | 0.6 | 3.3 |
| Sulfur, ppmw | 13 | 14 |
| Nitrogen[1], ppmw | 1 | 5 |
| Pour Point, ° C. | −27 | 3 |
| Cloud Point, ° C. | −20 | 3 |
| Viscosity, 40° C., cSt | 2.91 | 7.46 |
| Viscosity, 100° C. | 1.18 | 2.21 |
| Sim Dist. D 2887, ° C. | | |
| IBP, wt % | 183 | 274 |
| 5 pct off | 214 | 301 |
| 10 pct off | 225 | 311 |
| 30 pct off | 253 | 333 |
| 50 pct off | 273 | 348 |
| 70 pct off | 295 | 362 |
| 90 pct off | 319 | 379 |
| 95 pct off | 330 | 386 |
| FBP | 360 | 413 |

Notes:
[1]Total nitrogen, including contribution from additives
[2]Two rings and higher Table 3 shows that while it is possible to produce diesel fuels with extremely low levels of sulfur and nitrogen by isomerization processing of gas oil, the products may not possess the desired low temperature characteristics as manifested by the Pour Point and Cloud Point of Example 2.

These diesel fuels were tested for lubricity and gave the following results (HFRR ball on plate test, wear scar diameter):

| | | | |
|---|---|---|---|
| Ex. 1 | 406 μm | w/100 ppm P655* | 175 μm |
| Ex. 2 | 280 μm | | |

*Paramins Paradyne 655 ™, 100% long chain alkyl glycerol ester

The lubricity testing results show that the fuel with the higher end point, Example 2, has superior lubricity although both fuels were satisfactory for this aspect of performance with scars smaller than 460 μm.

EXAMPLES 3–5

Three diesel fuels were made by the isomerization dewaxing of a hydrocracker bottoms fraction and had the following properties set out in Table 5 below.

TABLE 5

| | Example 3 | Example 4 | Example 5 |
|---|---|---|---|
| API density | 39.1 | 36.2 | 35.1 |
| Density, g/cc | 0.8265 | 0.8438 | 0.8493 |
| Cetane Number | 55.34 | 60.42 | 68.64 |
| Total aromatics, wt % | 13.6 | 14.2 | 10.4 |
| Monoaromatics, wt. % | 10.3 | 8.7 | 4.7 |
| PNA, wt. % | 3.3 | 5.6 | 5.6 |
| Sulfur, ppmw | 4 | 3 | 1 |
| Nitrogen, ppm | 1 | 1 | 4.43 |
| Pour Point, C. | −57 | −48 | −39 |
| Cloud Point, C. | −51 | −43 | −33 |
| KV at 40° C. | 3.41 | 8.62 | 25.05 |
| KV at 100° C. | 1.31 | 2.39 | 4.88 |
| Aniline Point, C. | 79.5 | 93.6 | 111.10 |
| Distillation, D2887, ° C. | | | |

TABLE 5-continued

| | Example 3 | Example 4 | Example 5 |
|---|---|---|---|
| IBP, wt % | 203 | 259 | 349 |
| 5 pct off | 233 | 325 | 372 |
| 10 pct off | 242 | 332 | 384 |
| 30 pct off | 268 | 346 | 412 |
| 50 pct off | 289 | 355 | 434 |
| 70 pct off | 307 | 365 | 457 |
| 90 pct off | 324 | 381 | 486 |
| 95 pct off | 329 | 387 | 498 |
| FBP | 339 | 401 | 527 |

The results in Table 5 above show that road diesel fuels with low levels of sulfur and nitrogen with good combustion properties and excellent low temperature performance can be achieved. While the cetane of Ex. 5 is excellent, the high end point of this product leads to an excessively high viscosity, outside the range of a 2-D fuel (max viscosity 40° C. of 4.1 cSt).

What is claimed is:

1. A low sulfur D-2 (ASTM D975) diesel fuel having the following properties:

| | | |
|---|---|---|
| Cetane number | ASTM D613 | 45+ |
| Aromatics, total, wt. % | ASTM D5186 | <15 |
| Polynuclear aromatics, wt. %, | ASTM D2425 | <11 |
| Sulfur, ppmw, | ASTM D2622-1 | <50 |
| Nitrogen, ppmw (from all sources) | ASTM D4629 | <100 |
| Pour Point, ° C. | ASTM D97 | <−12 |
| Cloud Point, ° C. | ASTM D2500 | <−10. |

2. A low sulfur diesel fuel according to claim 1 having any one or more of the following properties:

| | |
|---|---|
| Cetane number | 50+ |
| Aromatics, total, wt. % | 10–15 |
| Polynuclear aromatics, wt. %, | 0.2–10. |

3. A low sulfur diesel fuel according to claim 2 having a cetane number of 55 to 68.

4. A low sulfur diesel fuel according to claim 2 having a polynuclear aromatics content of 0.5 to 5.0 wt. %.

5. A low sulfur diesel fuel according to claim 2 having a sulfur content of less than 50 ppmw.

6. A low sulfur diesel fuel according to claim 2 having a nitrogen content of not more than 50 ppmw.

7. A low sulfur diesel fuel according to claim 2 having any one or more of the following properties:

| | |
|---|---|
| Pour Point, ° C. | <−20 |
| Cloud Point, ° C. | <−20. |

8. A low sulfur diesel fuel according to claim 2 having a cloud point not higher than −28° C.

9. A low sulfur diesel fuel according to claim 1 which has an emissions level no higher than a CARB reference diesel fuel containing 10 volume percent maximum aromatics when tested against a reference diesel fuel according to the protocol of Subsection g of Section 2282, Title 13, California Code of Regulations.

10. A low sulfur diesel fuel according to claim 1 having any one or more of the following properties:

| | |
|---|---|
| Pour Point, ° C. | <−20 |
| Cloud Point, ° C. | <−20. |

* * * * *